United States Patent [19]

Lattuada

[11] 4,374,485

[45] Feb. 22, 1983

[54] SINGLE ANNULAR MEMBRANE TYPE OF PNEUMATIC POSITIONER

[75] Inventor: Sergio Lattuada, Bergamo, Italy

[73] Assignee: S.T.I. Strumentazione Industriale S.p.A., Gorle, Italy

[21] Appl. No.: 155,546

[22] Filed: Jun. 2, 1980

[30] Foreign Application Priority Data

Dec. 21, 1979 [IT] Italy ..... 2939 A/79

[51] Int. Cl.[3] ..... F15B 13/16

[52] U.S. Cl. ..... 91/387; 137/625.66

[58] Field of Search ..... 91/387, 382; 137/625.66

[56] References Cited

U.S. PATENT DOCUMENTS

| | | | |
|---|---|---|---|
| 2,225,321 | 12/1940 | Schwendner | 91/387 |
| 2,934,305 | 4/1960 | Farris et al. | 91/387 |
| 2,937,655 | 5/1960 | Vana | 91/387 |
| 2,966,891 | 1/1961 | Williams | 91/387 |
| 3,172,336 | 3/1965 | Warstler | 91/387 |

FOREIGN PATENT DOCUMENTS

| | | | |
|---|---|---|---|
| 1156420 | 12/1957 | France | 91/387 |

*Primary Examiner*—Paul E. Maslousky

[57] ABSTRACT

Single annular membrane type of pneumatic positioner associated with a servo control comprising a cylinder-piston assembly, feedback connected to the positioner, which includes a hollow body, internally of which there is provided at one side a reverse feedback spring controlled by the servo control, and at the other side a slide or distributing valve is provided, the inner cavity of the pneumatic positioner being separated by a single annular membrane, capable of being displaced under the action of an adjusting signal, said annular membrane being provided at the center with a hole through which a stem of the slide or distributing valve frictionessly slides, which stem bears against a dish-like member resting on the reverse feedback spring, while at the opposite side the slide or distributing valve bears on a low load spring.

3 Claims, 1 Drawing Figure

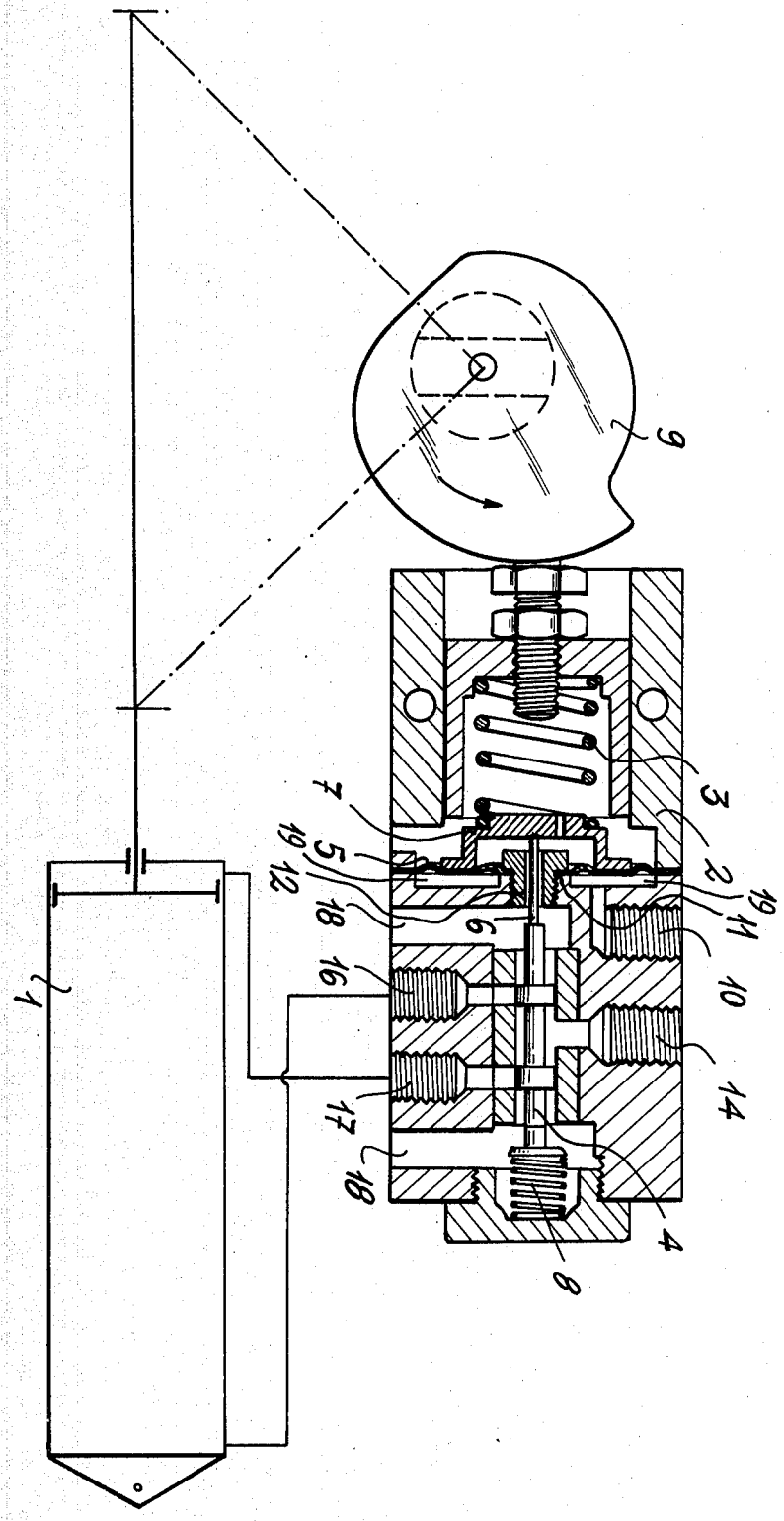
9
3
2
19
11
10
14
4
8
7
19
5
12
18
6
16
17
18
1

SINGLE ANNULAR MEMBRANE TYPE OF PNEUMATIC POSITIONER

This invention is concerned with a pneumatic positioner for pneumatic single or double acting servo controls, which positioner is provided according to the invention with a single annular membrane.

As well known, a pneumatic positioner is generally used for the actuation of pneumatic single or double acting servo controls to cause the servo control to take any position, even an intermediate position, depending on a pneumatic adjusting signal which is delivered to such a positioner.

Therefore, such positioners substantially comprise a hollow body, which is provided with suitable connections for the signal input, supply air inlet and so on, the hollow body being substantially divided into two parts, of which one is designed to supply the two chambers of the pneumatic servo control (cylinder-piston assembly) through a four-way distributor operated by the adjusting signal, whereas the other part is designed to receive the adjusting signal and the feedback signal which through suitable drive means returns to said servo control that was driven. The two parts of the positioner are divided or separated by a flexible assembly which can react both to the input adjusting signal and to the return signal from the servo motor.

Usually, in prior art positioners said flexible assembly comprises two paired membranes of differentiated surface, made integral by various dish-like members, between which the adjusting signal is effective.

Another known approach provides the adoption of only one membrane, in which a rubber seal or gasket of the O-ring type or equivalent is provided for allowing the movement and preventing any signal losses on the chamber.

A third known approach provides the use of only one membrane, but in a sequence in which the single membrane is coupled to the slide or distributing valve, on the opposite side of which relative to the membrane there is the reverse feedback spring in the sequence membrane-slide or distributing valve-reverse feedback spring.

It clearly appears from the prior art techniques that the larger is the number of membranes or the higher is the friction (provision of seals, gaskets, etc.) and the higher is the hysterisis phenomenon in the system, that is to say that the positioner would not react in the presence of slight signal changes, since the friction would remove the effect of the signal. Thus, it is necessary and essential that the membrane movement is transmitted without any friction to the slide or distributing valve of the positioner.

Also the attempt of resorting to the sequence membrane-slide or distributing valve-reverse feedback spring does not solve the problem, as said so arranged reverse feedback spring, which spring should be rather strong, causes the arise in said slide or distributing valve of forces directed in a lateral direction which cannot but increase the friction phenomenon, thus being still within the above described disadvantages.

Therefore, it is the object of the present invention to provide a pneumatic positioner, which is of simple and inexpensive construction and reliable in use, and which can particularly completely remove the friction phenomenon through the use of a generally hollow body defining an annular control-pressure air chamber and comprising a single annular membrane passed through by a central sealing hole, in which forms one of said air chamber and which defines a central opening through which the stem of a slide or distributing valve is movable without any mechanical contact either with the membrane or possible sealing elements, and bearing on a dish-like member controlled by the reverse feedback spring, at its other end said slide or distributing valve being in contact with a small low load spring.

The invention will now be described in detail with reference to the accompanying drawing, in which an unrestrictive exemplary embodiment is shown and in which the single FIGURE schematically shows a positioner according to the invention in its coupling scheme to a servo control.

Referring now to the drawing, reference numeral 1 designates a servo control substantially comprising a cylinder-piston assembly. This assembly 1 is driven by the positioner 2, as shown in the scheme of the accompanying drawing, which through a cam 9 enables in turn to deliver a reverse feedback signal to said positioner 2. All of this as conventional and well known to those skilled in the art and which therefore will not be herein further described. Said positioner 2 substantially comprises a hollow body, internally of which there is at one side provided a reverse feedback spring 3 controlled by said servo control 1 through said cam 9 in a force balance system. At the other side there is provided a slide or distributing valve 4, the inner cavity of the pneumatic positioner being separated or divided into two primary chambers by a single annular membrane 5, which can be displaced under the action of an adjusting signal arriving at 10. Annular membrane 5 serves to define with said inner cavity an annular control-pressure air chamber 19. As clearly shown in detail in the drawing, at the centrally perforated zone thereof, this single annular membrane 5 is sealingly secured with its inner annular edge 11 by a bolt 12 or any other means against the positioner body, such a bolt 12 or threaded connection being internally hollow for the passage of the connecting stem 6 of a slide or distributing valve 4 which at its other end is under the load of a small low load spring 8, which provides for maintaining a contact free of clearances between said slide or distributing valve 4, stem 6 and a dish-like member 7, with said reverse feedback spring 3 bearing there against at the opposite side.

Reference numerals 14, 16, 17 and 18 respectively designated the air supply, two outlets and two vents, the whole as conventional and the operation of which is per se known and per se evident and accordingly not within the field of the present invention.

Thus, as shown, it is the object of the invention to provide a positioner having only one annular membrane, free of seals or gaskets, in which the movement of membrane 5 is transmitted without any friction to the slide or distributing valve 4 by a small connecting stem 6 which is housed internally of the annular portion of the membrane, the contact between said slide or distributing valve 4, stem 6 and dish-like member 7 of membrane 5 being assured by a low load spring 8, provided at the end of the slide or distributing valve opposite to that at which said reverse feedback spring is provided.

Therefore, in the system according to the invention, the provision of only one membrane provides a lower hysterisis relative to the known systems having two or more differential membranes. Moreover, no friction is built up in the members connecting the membrane with the slide or distributing valve. Therefore, an improved sensitivity is provided in the positioner which responds to minimal changes in the adjusting signal, in addition of being of a higher constructive simplicity and accordingly of a lower cost of production.

Obviously, the invention is not limited to the details herein shown and/or described, but would include all of the changes and equivalent forms made on the ground of the inventive concept.

What I claim is:

1. A pneumatic positioner for use with a fluid motor having a piston rod, said pneumatic positioner comprising:

a generally hollow body defining an annular control pressure air chamber in said body;

an annular diaphragm forming one wall of said air chamber, said annular diaphragm having in its center an opening and being rigidly mounted to said body at both its inner and outer peripheries, a dish-like member engaging a circular area of said diaphragm between its inner and outer peripheries;

biasing means for applying a variable biasing force to said dish-like member in the direction of said diaphragm and in response to the position of the piston rod;

a valve stem engaging at its one end said dish-like member and extending through a hole in said body concentric with the center of said diaphragm and said air chamber, said valve stem being slidably movable within said hole without contact with said body;

a valve operably coupled to said valve stem for controlling the flow of fluid to and from said motor.

2. A positioner according to claim 1, wherein at an inner annular edge said annular diaphragm is sealingly clamped by an outwardly threaded bushing, said valve stem passing without contact internally of said opening.

3. A positioner according to claim 1, wherein said valve at its end opposite to said biasing means is subjected to the action of a low load spring.

* * * * *